US007468480B1

(12) United States Patent
Sikra

(10) Patent No.: US 7,468,480 B1
(45) Date of Patent: Dec. 23, 2008

(54) DUAL DRUM SUPPORT AND POSITIONING

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

(21) Appl. No.: 11/633,110

(22) Filed: Dec. 4, 2006

Related U.S. Application Data

(60) Provisional application No. 60/759,593, filed on Jan. 17, 2006.

(51) Int. Cl.
*G10D 13/02* (2006.01)

(52) U.S. Cl. ..... 84/421

(58) Field of Classification Search ..... 84/421
See application file for complete search history.

(56) References Cited

U.S. PATENT DOCUMENTS

| | | | | | |
|---|---|---|---|---|---|
| 241,195 | A * | 5/1881 | Cubley | 84/421 |
| 2,245,883 | A * | 6/1941 | Walberg | 84/421 |
| 3,405,587 | A * | 10/1968 | Remo et al. | 84/421 |
| 4,126,075 | A * | 11/1978 | Kurosaki | 84/421 |
| 4,337,684 | A * | 7/1982 | Le Mert | 84/421 |
| 5,202,527 | A * | 4/1993 | Gracie | 84/327 |
| 5,467,680 | A * | 11/1995 | Kurosaki | 84/421 |
| 5,797,569 | A * | 8/1998 | Simons | 248/187.1 |
| 5,973,249 | A * | 10/1999 | Liao | 84/421 |
| 6,075,190 | A * | 6/2000 | Mosser et al. | 84/421 |
| 6,281,417 | B1 * | 8/2001 | Ladao | 84/327 |
| 6,384,308 | B1 * | 5/2002 | Hoshino | 84/421 |
| 6,710,236 | B2 * | 3/2004 | Takegawa | 84/421 |
| 6,723,907 | B2 * | 4/2004 | Sato | 84/421 |
| 6,963,023 | B2 * | 11/2005 | Hsieh | 84/421 |
| 7,087,826 | B1 * | 8/2006 | Lombardi | 84/421 |
| 7,087,827 | B2 * | 8/2006 | Liao | 84/421 |
| 7,205,469 | B2 * | 4/2007 | Chang | 84/421 |
| 7,268,283 | B1 * | 9/2007 | Sikra | 84/421 |
| 7,294,775 | B1 * | 11/2007 | Spoljaric, Jr. | 84/421 |
| 7,307,206 | B2 * | 12/2007 | Payerl | 84/421 |
| 2005/0103184 | A1 * | 5/2005 | Hsieh | 84/421 |
| 2005/0274854 | A1 * | 12/2005 | May | 248/171 |

OTHER PUBLICATIONS

Pearl Fit All Tilting Bongo Drum Stand, on sale at Music 123, reviewed Jan. 22, 2006, viewed Sep. 9, 2008 at http://www.music123.com/Pearl-Fit-All-Tilting-Bongo-Stand-448752-i1140605. Music123.*

* cited by examiner

*Primary Examiner*—Walter Bensom
*Assistant Examiner*—Robert W Horn
(74) *Attorney, Agent, or Firm*—William W. Haefliger

(57) ABSTRACT

Bongo drum apparatus that includes a stand, an integrating interconnection between the bongo drums, and a clamp for clamping the stand to the integrating interconnection.

1 Claim, 5 Drawing Sheets

DUAL DRUM SUPPORT AND POSITIONING

BACKGROUND OF THE INVENTION

This application claims priority from provisional application Ser. No. 60/759,593, filed Jan. 17, 2006.

This invention relates generally to supporting of percussion instruments such as bongo drums during performances, and more particularly to collapsible support apparatus, that can be quickly extended to support such drums, during performances.

There is need for such apparatus that can be collapsed for transport, that can quickly be extended when needed, and that is adjustable, for example to change or adjust height of the drums to suit the drummer, and also to adjust lateral positioning and tilting of the drums. There is also need for a way to allow expansion of the apparatus to a pre-set, or pre-adjusted position, so that the drum support need not be adjusted each time the drummer installs his drumming equipment at performance locations.

Also needed is a way to adjustably support a pair of bongo drums, which are rigidly interconnected.

SUMMARY OF THE INVENTION

It is a major object of the invention to provide improved apparatus meeting the above need, and comprising:

a) a stand, b) an integrating interconnection between the bongo drums, c) and a clamp for clamping the stand to said integrating interconnection.

Another object is to provide the support to extend between the bongo drums, and positioned to be urged upwardly, with the two drums, and into engagement with a clamp member carried by the stand to engage an upper surface of the support. This allows for provision of a clamp adjuster extending from the clamp at an accessible level below the support.

A further object is to provide clamp linkage elements adjustable to exert upward loading on the drums to thereby urge the support upwardly against said member. Such linkage elements typically may include first links having pivotal operative connection to an upright component of the stand, to be swung upwardly beneath the levels of the drums and urge the drums and said support upwardly relative to said clamping member. The linkage elements may include second links having pivotal operative connection to the first links and connection to a pusher associated with said upright component, whereby upward displacement of the pusher relative to the stand causes said first links to be swung to urge the drums upwardly.

Yet another object includes provision of protective pads on the first links to engage lower edge portions of the drums, the first links extending generally oppositely relative to the stand.

An added object includes provision of a stand that includes a main upright post, said upright component offset laterally from said post. Adjustable means may be carried by the post, and carrying the upright component for controllably tilting the drums, in unison. As will be seen, the adjustable means may include a laterally extending part, and a bearing carried by the post, said part carrying the upright component and said bearing carrying said part to allow swiveling thereof about a lateral axis.

Further, level adjusting means may be provided to adjust the relative levels of said linkage elements whereby the levels of the drums are also adjustable during clamping of the support by said member.

A yet further object is to provide dual drum apparatus that comprises a) a stand, b) a structural support that extends between and connects to side walls of the dual drums, c) and adjustable clamp means carried by the stand and clamping to said support and to bottom rims of the dual drums, to hold the drums in position relative to the stand.

These and other objects and advantages of the invention, as well as the details of an illustrative embodiment, will be more fully understood from the following specification and drawings, in which:

DRAWING DESCRIPTION

DETAILED DESCRIPTION

Figure 1:
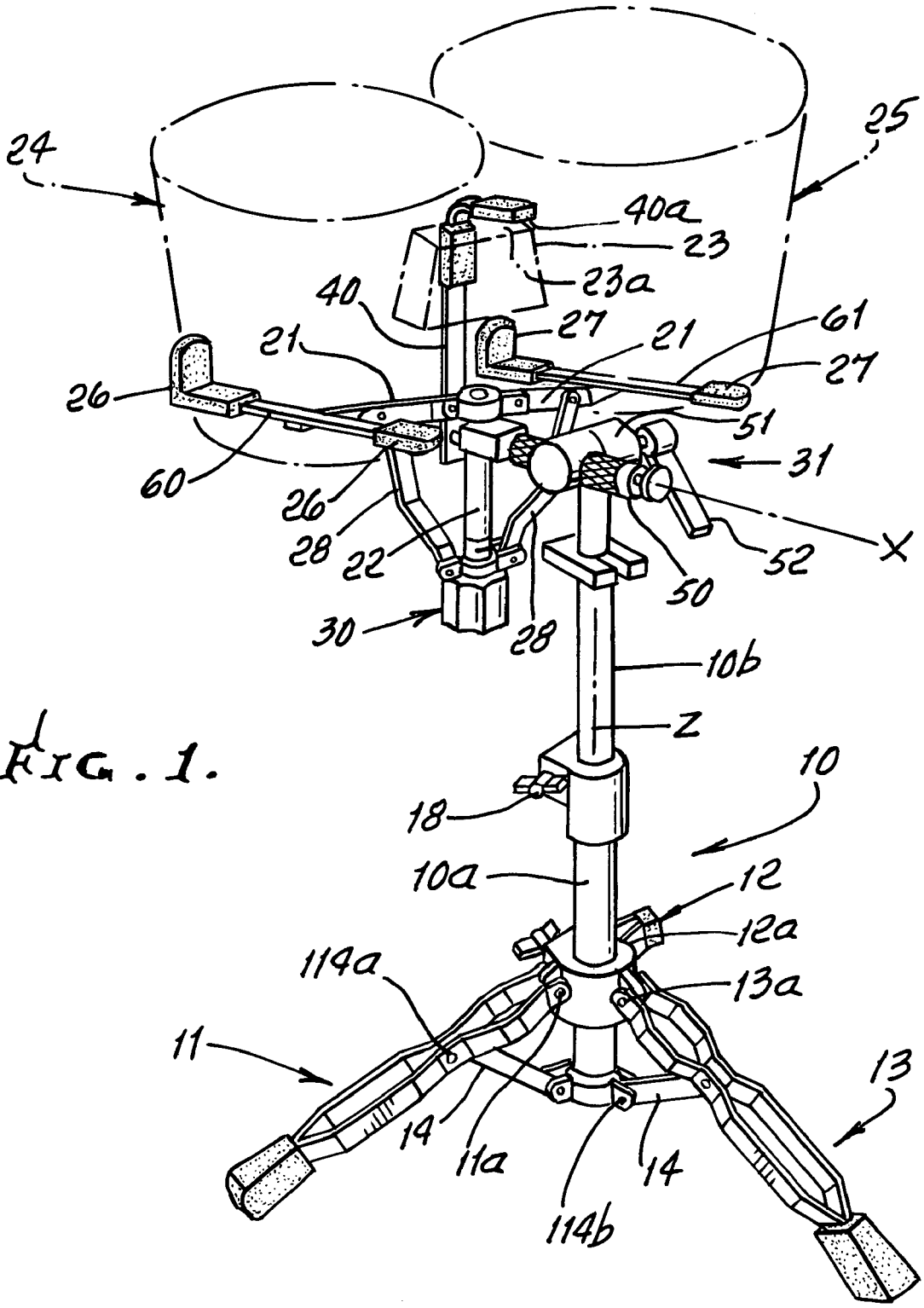
FIG. 1 is a perspective view of apparatus incorporating a preferred form of the invention, the apparatus expanded or deployed for use.
Figure 2:
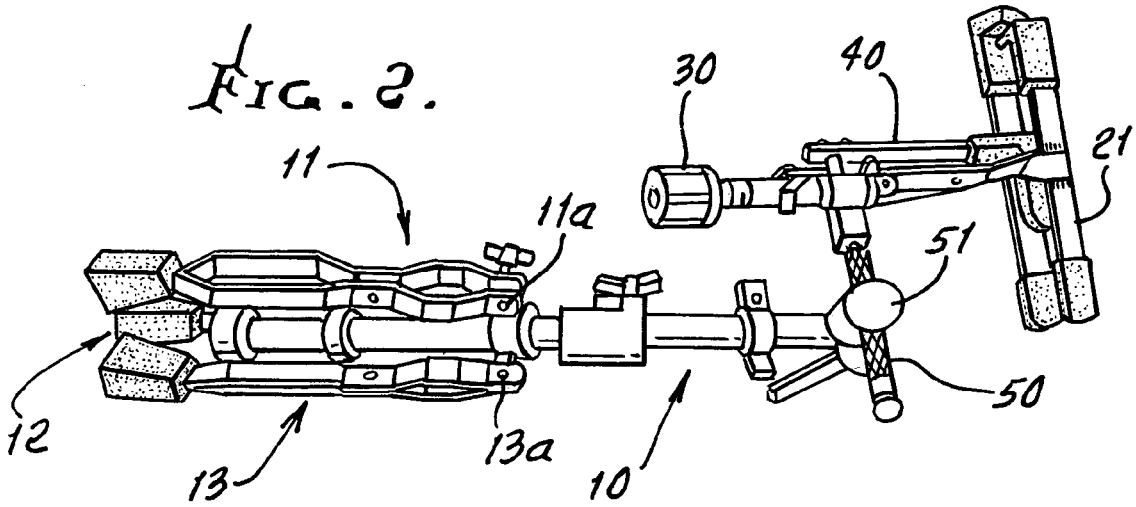
FIG. 2 is a view of the FIG. 1 apparatus in collapsed condition, as for transport.
Figure 3:
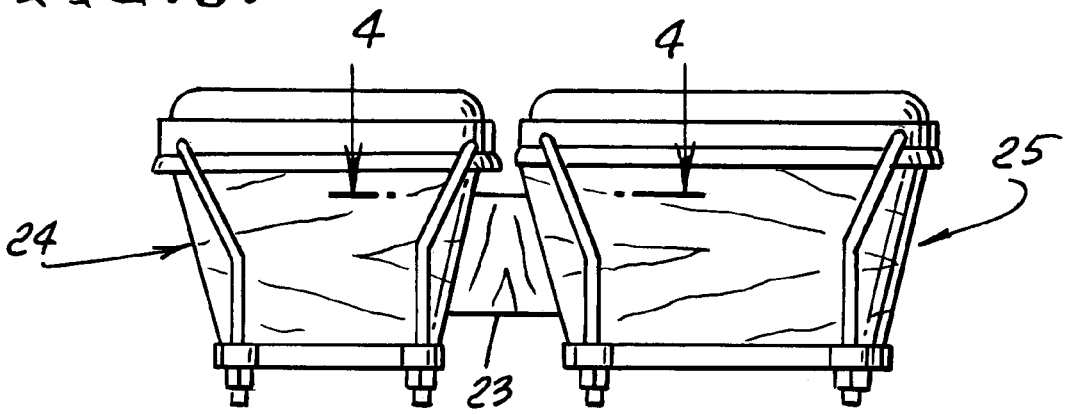
FIG. 3 is an enlarged side view showing two bongo drums, and their interconnection.
Figure 4:
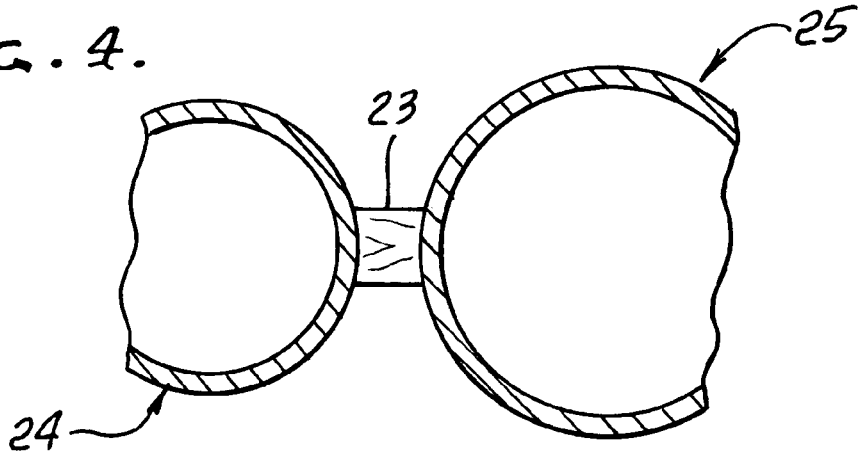
FIG. 4 is a view taken on lines 4-4 of FIG. 3.

Referring first to FIGS. 1 and 2, a percussion instrument stand 10 extends in upright position, to be supported by legs 11-13. Those legs may be hinge connected to the stand 10, as at hinge locations 11*a*-13*a*, to be folded into generally parallel relation to the stand, as for transport. See FIG. 2. Stabilizing links 14 may be used, and hinge connected to the legs at 114*a*, and to the stand lower extent at 114*b*, enabling folding toward the stand. The stand 10 may have telescoping sections 10*a* and 10*b*, with a set screw 18 to be tightened to hold the sections at selected extensions.

Figure 5:
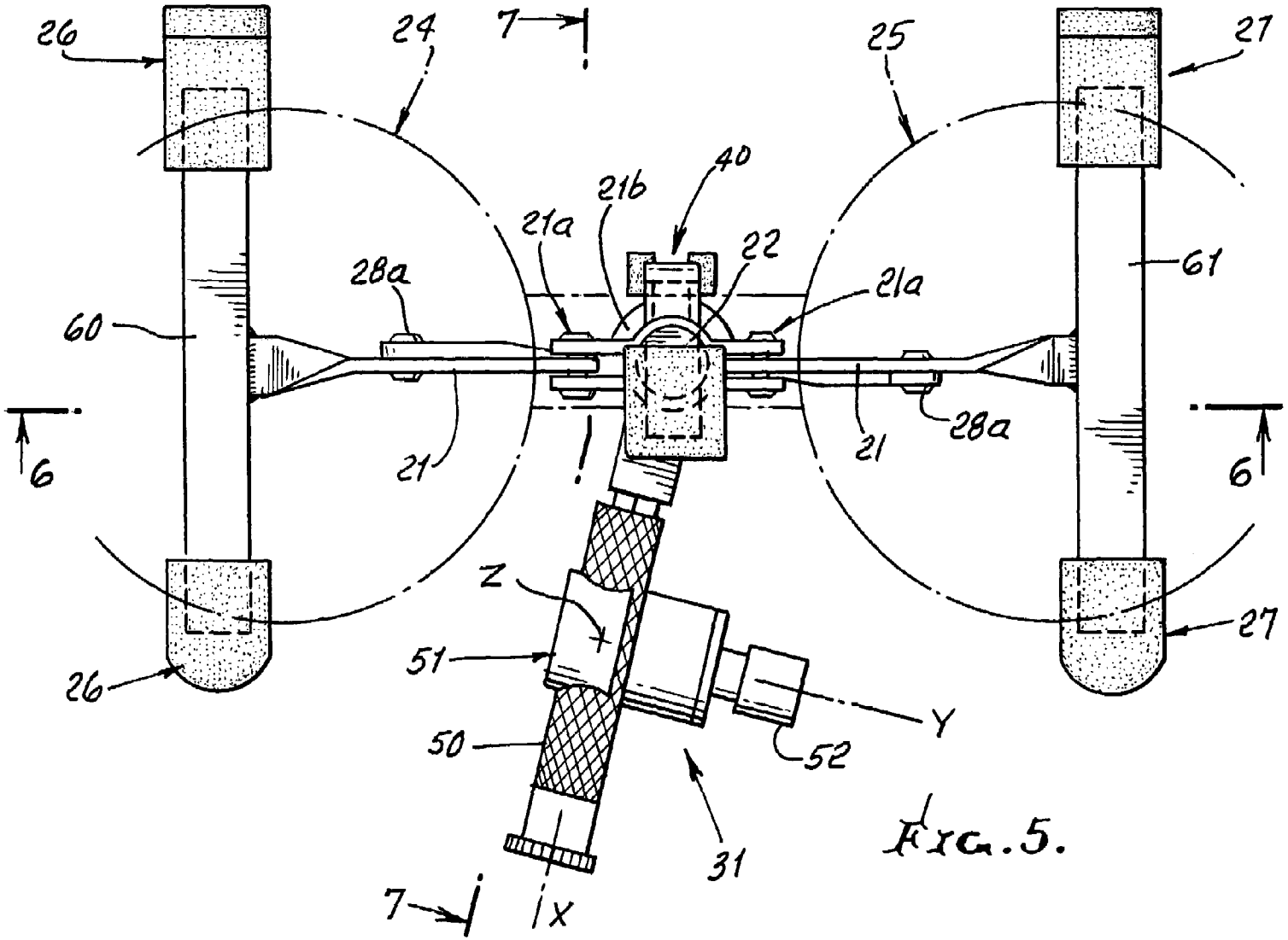
FIG. 5 is an enlarged plan view showing adjustable clamping means acting on the two drums and on a support that interconnects the drums.
Figure 6:
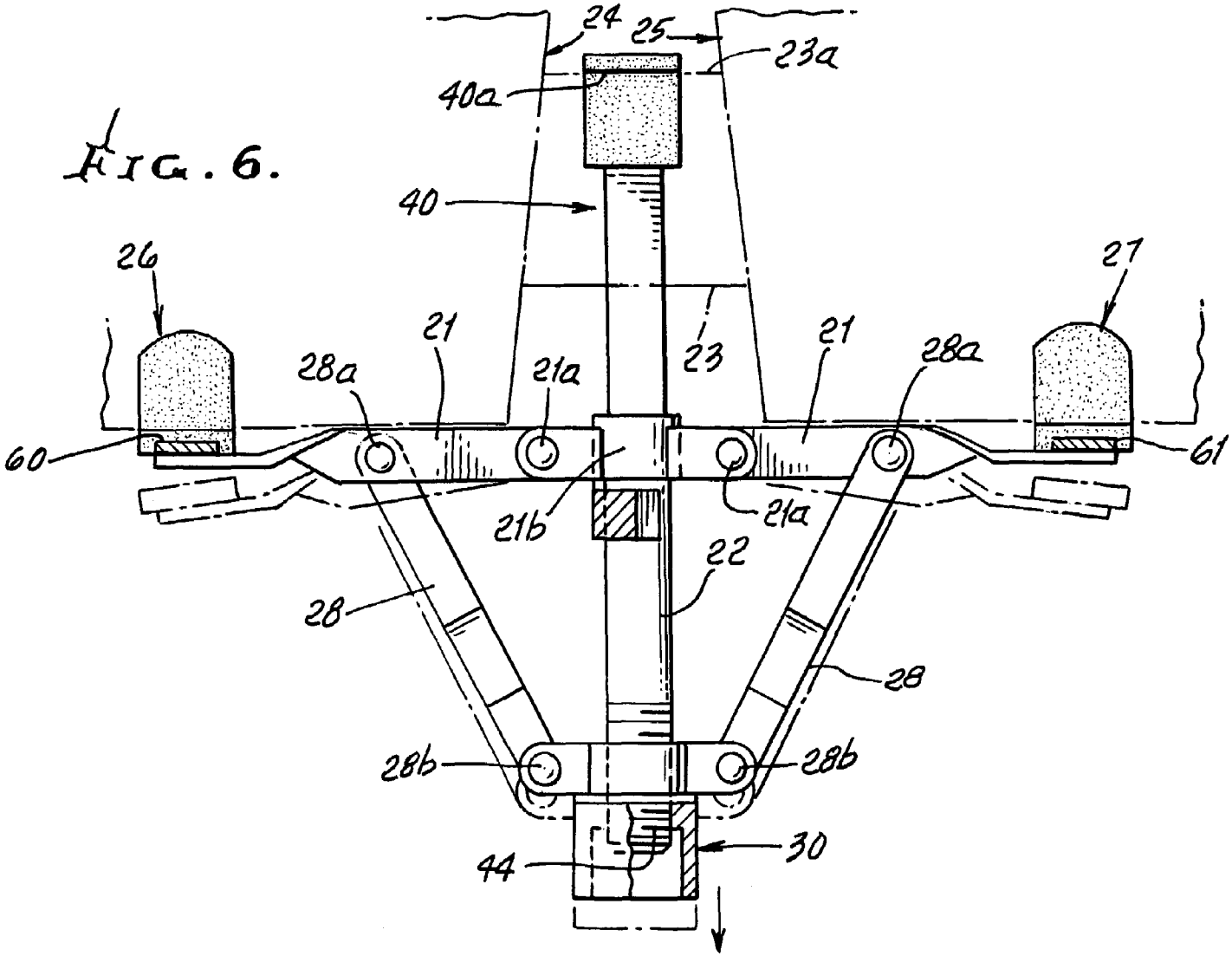
FIG. 6 is an elevation taken on lines 6-6 of FIG. 5.

Linkage elements are provided, including first links 21 having operative connection to the stand, as via an upright component or shaft 22, so that the links 21 are swingable upwardly beneath the levels of the drums, to urge the drums upwardly along with a structural support 23. That support extends between the two drums 24 and 25 to rigidly interconnect them. The outer ends of the first links 21 carry struts 60 and 61 that in turn carry L-shaped protective L-shaped pads 26 and 27 that engage and support lower edge portions of the two drums. See FIGS. 5 and 6 also showing link pivotal connections 21*a* to collar 21*b* on post 22.

The linkage elements also include second links 28 with upper end pivotal operative connection to the first links, as at 28*a*, and lower end pivotal operative connection at 28*b* to a pusher 30. The pusher is associated with the upright component or shaft 22 which is offset laterally from the stand 10. That offset relationship allows for inclusion of adjustment mechanism, generally indicated at 31, and which enables adjustment swiveling of the upright component or post 22 and the drums, about X, Y and Z axes, which extend in a three-dimensional coordinate rectangular relationship, whereby the drums, such as bongo drums, may be adjustably swiveled universally, as well as swiveled, to best fit the drum player's arm position requirements and drum addressing requirements.

Figure 7:
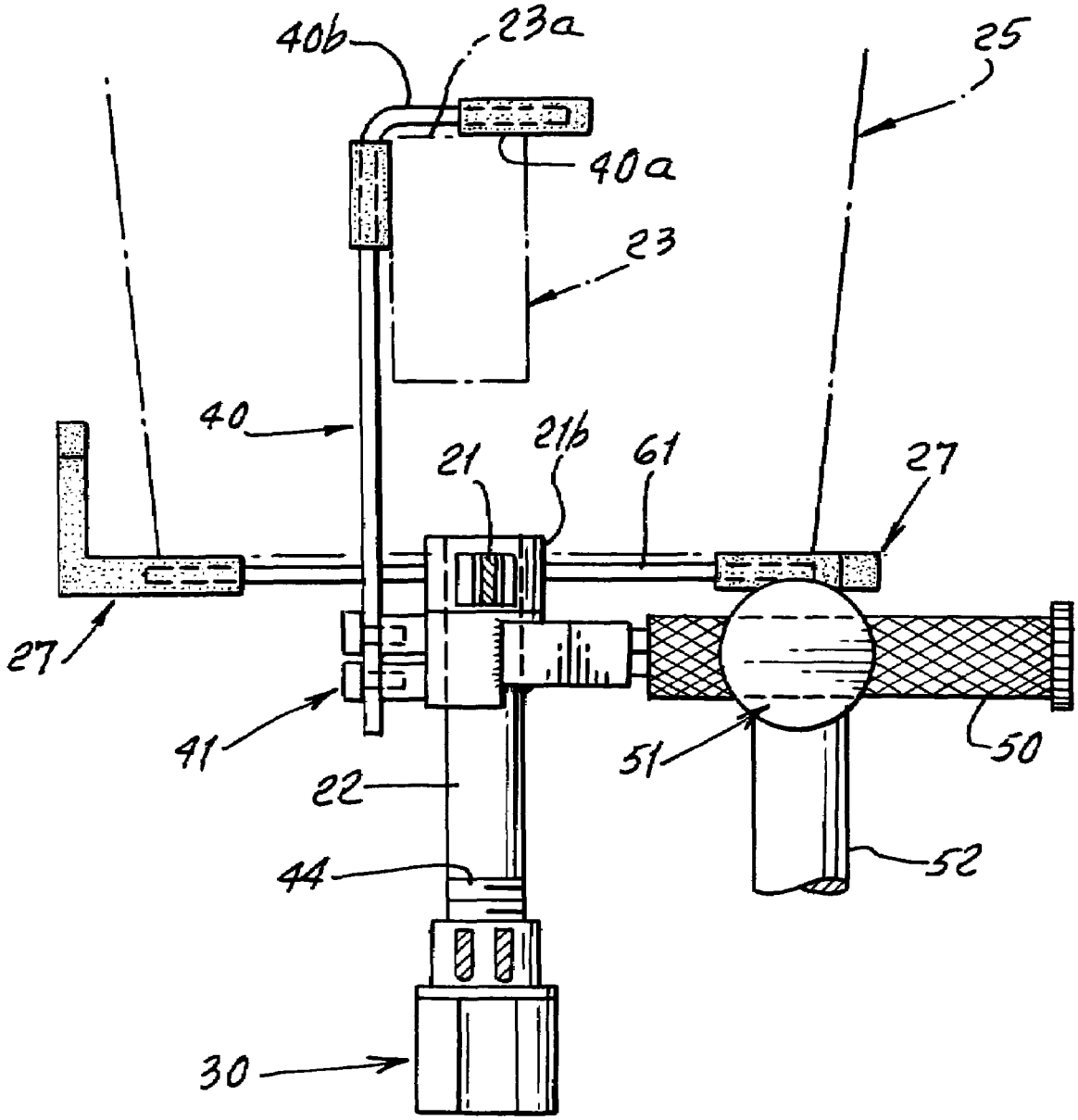
FIG. 7 is another elevation taken on lines 7-7 of FIG. 5.

It will be noted that as the drums and structural support 23 are urged upwardly, they become clamped in a position spacially fixed relative to upright component 22. See FIG. 6. This occurs because the upper surface 23*a* of support 23 comes into clamped engagement with the under surface 40*a* of an L-shaped clamping member 40. The latter extends upwardly from a connection at 41 to the post 22 (see FIG. 7), to a laterally extending portion 40*b* of member 40, as shown. The linkages are urged upwardly by rotation of the pusher 30 (for example an adjusting nut). The latter may have threaded connection to post 22, as at 44, seen in FIG. 7, to be moved up or down as it is adjustably rotated. Use of threads prevents inadvertent up or down travel of the nut, and inadvertent tilting of the drums.

As referred to above, adjustable means is carried by the stand 10, for carrying the post 22, to adjust its position in multiple dimensions. For example, the post 22, and drums, can be rotatably adjusted about multiple axes X and Y of the X-Y-Z rectangular coordinate system, thereby to selectively tilt the drums universally.

See for example laterally extending part 50 (such as a shaft) connected between the stand 10 and the post, and the bearing structure 51 located operatively between the part 50 and the stand 10. As shown in FIG. 1, when a clamp handle 52 is loosened, the bearing allows part 50 to be rotated about the X axes, to tilt the drums about that axis.

The bearing structure also allows adjustment tilting of part 50 and post 22 about the Y axis, when the clamp handle 52 is loosened, that axis being at right angles to the X axis. The bearing structures may also allow rotation of the part 50, post 22 and drums about an upright Z axis, defined by stand 10, when the clamp handle is loosened. Tightening of that handle, fixes 20 and 50 in swiveled adjusted position, in space, whereby the drums are both swivel accommodated in multiple dimensions, to the drummer, and to be fixed in position.

The disclosure of U.S. patent application Ser. No. 10/933,443, filed Sep. 3, 2004, is incorporated herein by reference.

I claim:

1. Bongo drum apparatus, comprising a) a stand, b) an integrating interconnection between the bongo drums, c) and a clamp for clamping the stand to said integrating interconnection, d) the clamp including a clamping member extending upwardly to a level to exert downward loading on said integrating interconnection which defines a support, and the clamp including linkage elements adjustable to exert upward loading on the drums to thereby urge the support upwardly against said member, e) the linkage elements include first links having first means defining pivotal operative connection to an upright component of the stand, for upward swinging beneath the levels of the drums and urging of the drums and said support upwardly relative to said clamping member, f) the linkage elements also include second links having second means defining pivotal operative connection to the first links, there being a pusher associated with said upright component, said second means also having operative connection with the pusher whereby upward displacement of the pusher relative to the stand causes said first links to be swung to urge the drums upwardly, g) the stand including a main upright post, said upright component offset laterally from said post, h) and including adjustable means carried by the stand and carrying said upright component to adjust its position about two rectangular coordinate axes X and Y which project from a locus spaced above the level of said pusher, said locus offset from a third axis defined by said upright component, i) and wherein said adjustable means include a laterally extending part and a bearing carried by the post, said part carrying the upright component and said bearing carrying said part in position for swiveling thereof about both said X and Y axes, said Y axis extending toward the upright component.

* * * * *